US007866592B2

(12) United States Patent
Taylor

(10) Patent No.: US 7,866,592 B2
(45) Date of Patent: Jan. 11, 2011

(54) REVOLVING RACK FOR CHAIN SPOOLS

(75) Inventor: TJ Taylor, Silvis, IL (US)

(73) Assignee: Drives Incorporated, Silvis, IL (US)

( * ) Notice: Subject to any disclaimer, the term of this patent is extended or adjusted under 35 U.S.C. 154(b) by 459 days.

(21) Appl. No.: 11/687,355

(22) Filed: Mar. 16, 2007

(65) Prior Publication Data

US 2008/0223970 A1 Sep. 18, 2008

(51) Int. Cl.
*B65H 67/00* (2006.01)

(52) U.S. Cl. ..... 242/559.1; 242/560; 211/85.5

(58) Field of Classification Search ..... 242/557, 242/558, 559, 559.1, 559.2, 559.3, 560, 560.2; 211/1.52–1.56, 44, 78, 85.5, 164
See application file for complete search history.

(56) References Cited

U.S. PATENT DOCUMENTS

| | | | | | |
|---|---|---|---|---|---|
| 980,534 | A | * | 1/1911 | Kerr | 242/594.4 |
| 991,827 | A | * | 5/1911 | Capers | 242/594.1 |
| 1,789,481 | A | * | 1/1931 | Stone | 242/599.1 |
| 1,828,297 | A | * | 10/1931 | Schmidt | 242/559 |
| 2,590,384 | A | * | 3/1952 | Dent et al. | 242/532.6 |
| 3,426,912 | A | * | 2/1969 | Perini | 211/121 |
| 4,819,887 | A | * | 4/1989 | Dueck | 242/527.5 |
| D381,833 | S | * | 8/1997 | Farndon | D6/409 |
| 5,938,145 | A | * | 8/1999 | Dueck | 242/559.4 |
| 6,086,175 | A | * | 7/2000 | Yang | 312/268 |

* cited by examiner

*Primary Examiner*—William E Dondero
(74) *Attorney, Agent, or Firm*—Vedder Price P.C.

(57) ABSTRACT

The present disclosure relates to a revolving rack for the distribution and storage of chain on spools and a method of distribution and storage thereof, and more specifically, to a revolving rack with multiple spools placed on removable spool holders attached to a manual or automatic rotating mechanism that is user activated to place a selected spool at a desired operative position for distribution of chain. The revolving rack including a rotating mechanism connected to a frame with two roller chains placed on bottom sprockets and top sprockets having a built-in mechanism to hold a selected spool at a fixed height. Spools are inserted in spool holders and then adapted on the revolving rack. A drive mechanism rotates the spool holders a desired position either manually or electrically. The revolving rack also includes a sturdy frame having an operative section for receiving the rotating mechanism and a fixation section with a forklift-type interface. The spool holders include a central support placed on a spool holder equipped with a friction based stabilizer to prevent rotation and unwinding of chain.

8 Claims, 8 Drawing Sheets

REVOLVING RACK FOR CHAIN SPOOLS

FIELD OF THE DISCLOSURE

The present disclosure relates to a revolving rack for the distribution and storage of chains on spools and a method of distribution and storage thereof, and more specifically, to a revolving rack with multiple spools placed on removable spool holders attached to a manual or automatic rotating mechanism that is user activated to place a selected spool at a desired operative position for distribution of chains.

DEFINITIONS

Within the scope of this disclosure, the word "chain" or "chains" is defined as any material such as chains, cables, lines, thread, wire, tape, yarn, jewelry, or any other flexible, longitudinal material capable of being stored on a spool or any variation thereof. The word "spool" is defined as a cylinder or reel, in some instances hollow, having rims or ridges at each end on which a chain as defined above is wound for storage or distribution. The term "industrial chain" is defined as a subset of the chains defined hereabove and is made of industrial size metallic based chains used in the industry such as a roller chain or ball chain.

BACKGROUND

Chains are purchased either on spools or in other formats and then wound on spools using spooling machines. Suppliers sell industrial, commercial and other types of chains in great lengths for storage and contemporaneous use in segments. Segments of chain are generally used for daily use and are obtained by cutting chain using known chain separation techniques. Roller chains, one of the most common type of drive chain, is best known by a recognized use in the cycling industry. Chains are used to transfer rotational forces from a first axis, such as a bicycle crank, to a second axis, such as the rear wheel of a bicycle. Sprockets are attached to both axes to secure the chain to the axes and to help transfer the driving force. Roller chains, unlike some other chains, are segmented at fixed-link distances based on link sizes.

Users of chain often need to purchase and store different sizes, types, and grades of chain in anticipation of different needs. Maintenance departments with large industrial equipment with different sprockets sizes must keep different spools, each with a chain of different size. Bicycle repair shops using a normalized size of chain are forced to keep different grades of chains to meet a demand from casual bikers to experienced professionals. Spools are often sold with circular rims to protect the chains when loaded on the spools. Spools are generally stored sideways on the floor or in a designated storage place to prevent rolling on the rounded edges of the rims and unwinding of the chain stored within the spool. Sideways storage is problematic because with time and low-level floor vibration, the chain unwinds and slowly collects at the bottom of the spool.

In the case of industrial chains, spools are quite heavy and difficult to manipulate. For example, in a motorcycle equipment and repair shop, mechanics must find the right chain from among a group of spools in the repair shop, rearrange the spools until the one needed is within reach, turn the selected spool on its side, and unspool a length of chain while preventing the spool from rolling away in the opposite direction. In large shops with several repair bays, the spool must often be carried over long distances. The transportation of a spool is also problematic because the spool often has no handle and chain may inadvertently touch the floor and collect dirt.

What is needed is an apparatus capable of managing, storing, and distributing a specific type and grade of chain from a plurality of spools. What is also needed is a portable spool storage system that may be moved from one location to another in a single step. What is also needed is a robust apparatus capable of continued operation in an industrial environment and capable of manipulation by transportation devices such as a forklift.

SUMMARY

The present disclosure relates to a revolving rack for the distribution and storage of chain on spools and a method of distribution and storage thereof, and more specifically, to a revolving rack with multiple spools placed on removable spool holders attached to a manual or automatic rotating mechanism that is user activated to place a selected spool at a desired operative position for distribution of chain. The revolving rack including a rotating mechanism connected to a frame with two roller chains placed on bottom sprockets and top sprockets having a built-in mechanism to hold a selected spool at a fixed height. Spools are inserted in spool holders and then adapted on the revolving rack. A drive mechanism rotates the spool holders a desired position either manually or electrically. The revolving rack also includes a sturdy frame having an operative section for receiving the rotating mechanism and a fixation section with a forklift-type interface. The spool holders include a central support placed on a spool holder equipped with a friction based stabilizer to prevent rotation and unwinding of chain.

DETAILED DESCRIPTION

Figure 1:
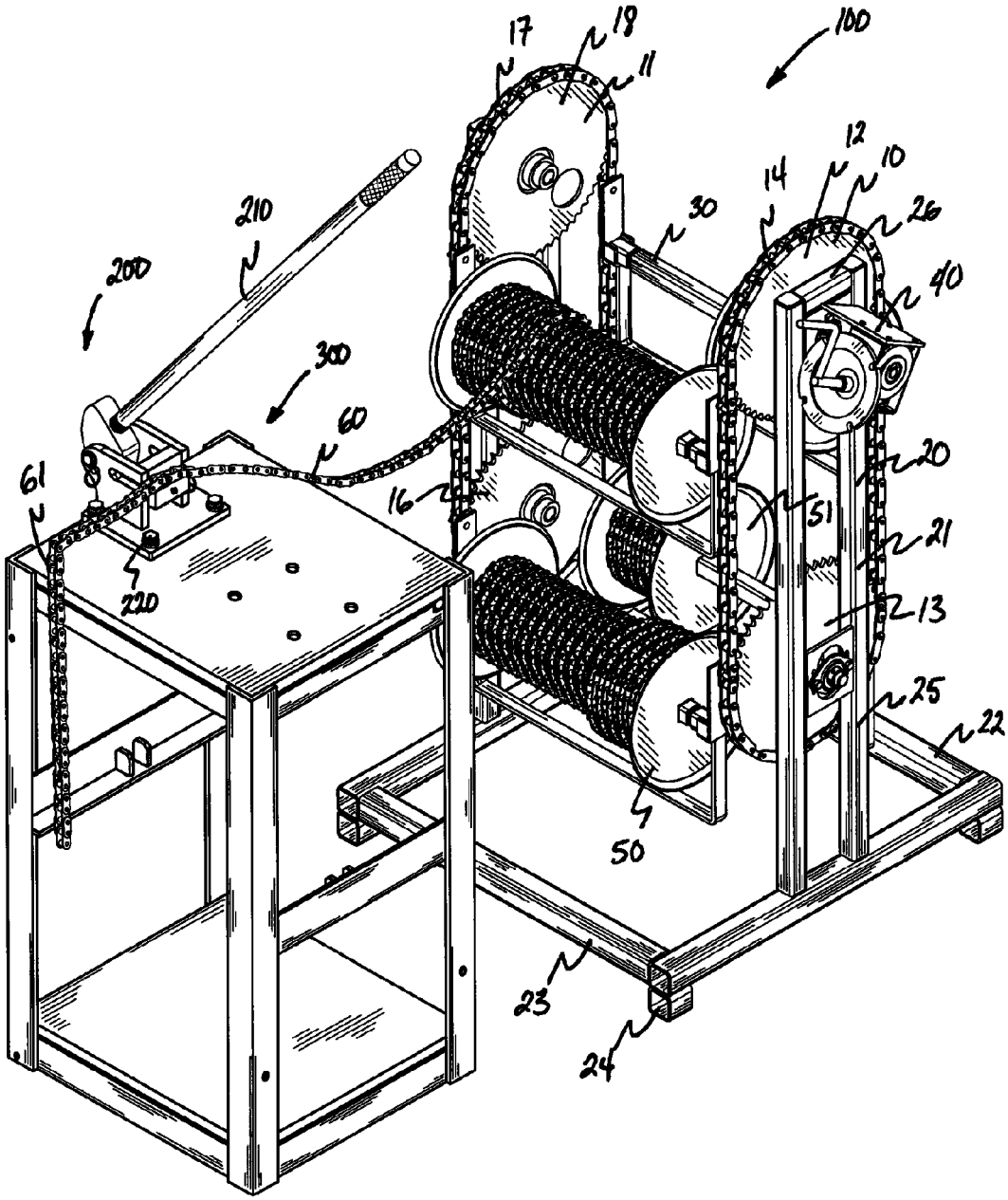
FIG. 1 is a perspective view of the revolving rack for chain spools without a guard placed in an operative configuration with a manual chain link breaker on a workbench.

FIG. 1 shows a revolving rack 100 for chain spools 50 without a guard 70 in an operative configuration and placed next to a manual chain link breaker 200 attached to a workbench 300. FIG. 1 shows a segment 61 of chain 60 unwound from the chain spool 50 over a desired length and placed within a roller chain link breaker 200. The chain link breaker 200 as shown is a manually operated device with a handle 210 to open links and cut chain 60 at a desired length. In one contemplated embodiment, a compact cutting tool called the EZ Breaker™ from Drives Incorporated is used. The EZ Breaker™ is attached to the workbench 300 using four bolts 220. While one possible type of device to create a segment 61 from a chain 60 is shown, what is contemplated is the use of any device, workbench, tool, and apparatus to create and remove segments 61 from the chain 60 used in tandem with the revolving rack 100.

Figure 6:
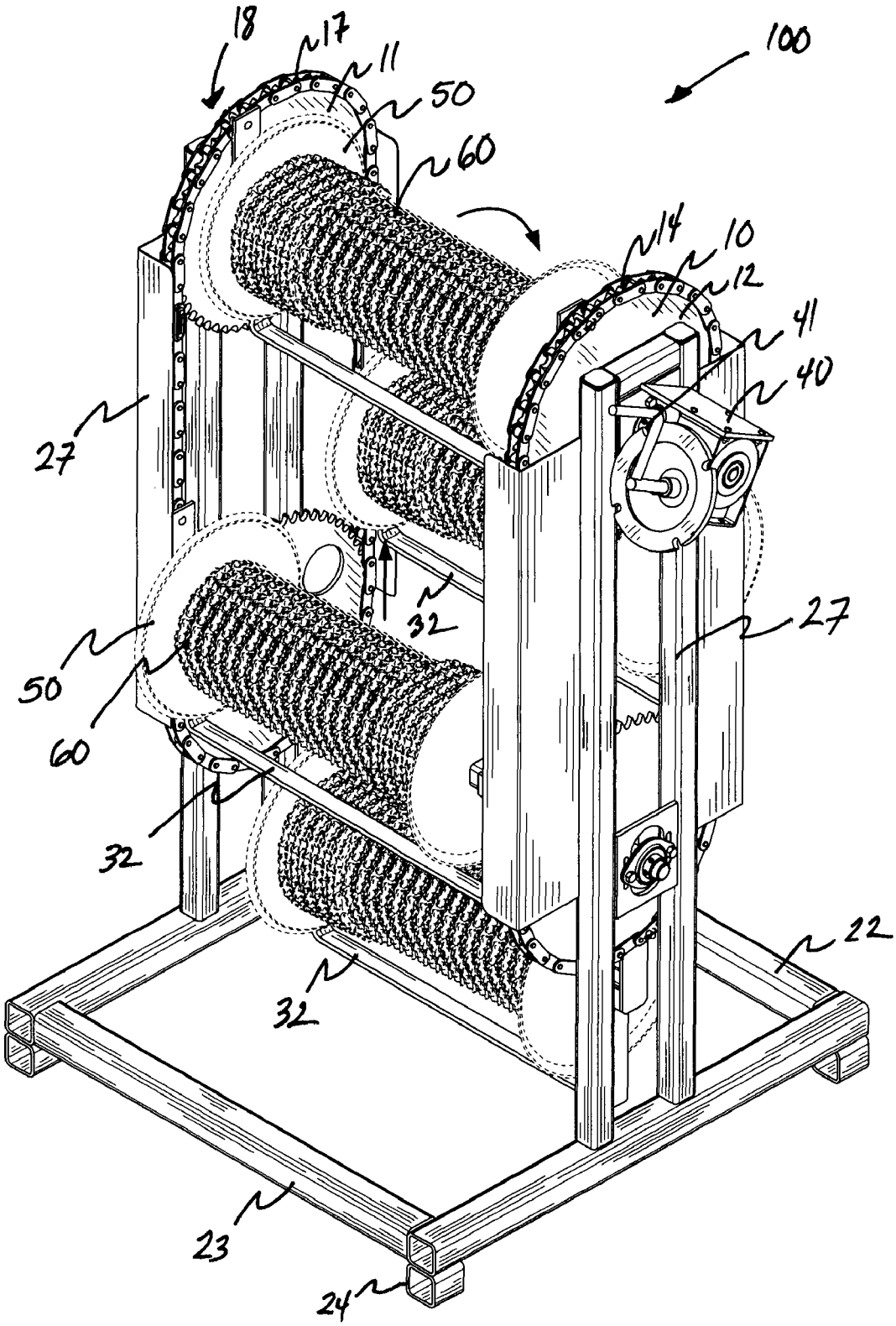
FIG. 6 is a perspective view of the revolving rack of FIG. 3 with spools and chains.

FIG. 1 shows a revolving rack 100 for chain spools 50 with a frame 20. The frame as described has an operative section 21 and a fixation section 22. The revolving rack 100 also includes a rotating mechanism 10 connected to the operative section 21 of the frame 20 for holding a plurality of spool holders 30. A drive 40 is connected to the rotating mechanism 10 for moving the plurality of spool holders 30 as shown from a inoperative position to an operative position. FIG. 6 shows an embodiment of the rotation mechanism 10 in an inoperative position (raised from the operative position shown as FIG. 1). A user engages the drive 40 to initiate rotation of the rotation mechanism 10 around the sprockets 11 as shown. The force from the drive 40 is transferred in the shown embodiment from the top right sprocket 12 to the bottom right sprocket 13 via the first roller chain 14. The bottom right sprocket 13 is united to the bottom left sprocket 16 by an axis 15 and allows for transfer of any movement between both bottom sprockets 13, 16 to be uniform. A second roller chain 17 is used to transfer movement to the upper left sprocket 18. The rotating mechanism 10 allows for rotational displacement of both of the roller chains 14, 17 to be in tandem and for an associated movement of the spool holders 30 attached to the rotating mechanism 10. The drive 40 is equipped with an internal clutching mechanism (not shown) to prevent backward rotation of the rotation mechanism 10.

What is contemplated is a revolving rack 100 where a user (not shown) is able to take a spool 50 of any width capable of being placed inside of the spool holder 30 and inserting the spool 50 in the operative section 21 of the frame 20. FIG. 1 shows a situation where spools 50 of a maximum allowable width are place in the front portion of the revolving rack 100 and one spool 51 of a smaller width is placed in the back portion of the revolving rack 100. What is contemplated is the use of frames 20 having an operative portion 21 of sufficient width to hold spools of sizes adequate to meet the needs of the industry. What is also contemplated is either the use of smaller spools 51 or the use of a plurality of smaller spools 51 on a single spool holder 30 to better manage the storage and distribution of chain 60 on the revolving rack 100.

In one embodiment, what is contemplated is the freewheeling of spools 50 on the spool holders 30. In another embodiment, what is contemplated is the use of a friction base rotational limiter built-in a central support 34 inserted in the spool 50 for placement on the spool holder 30 where each end is equipped with a rotating end 35 on the pivot 31. What is also contemplated is the use of a lock nut (not shown), a friction washer (not shown) used in association with a locking torque used to create friction between the central support 34 and the rotating ends 35.

One of ordinary skill in the art recognizes that different types of chains 60 may require a constant winding tension or force within the chain 60 during the different states of distribution or storage. The use of automatic tension devices in association with the spool holders 30 is also contemplated. One of ordinary skill in the art also recognizes that by using spools 50 in a freewheeling mode on the spool holder 30, which in turn is attached to a rotating mechanism 10 in a freewheeling mode, the spools 50 are not forced to rotate when the drive 40 is activated to move the rotating mechanism 10, and ultimately, chain 60 from the spools 50 does not unwind when moving from a first inoperative position to an operative position. The use of a central support 34 fixed rotationally with the rotating ends 35 also allows for a passage from a first inoperative position to an operative position without unwinding of the chain 60 by allowing the spool holder 30 to rotating within the rotating mechanism 10.

Figure 7:
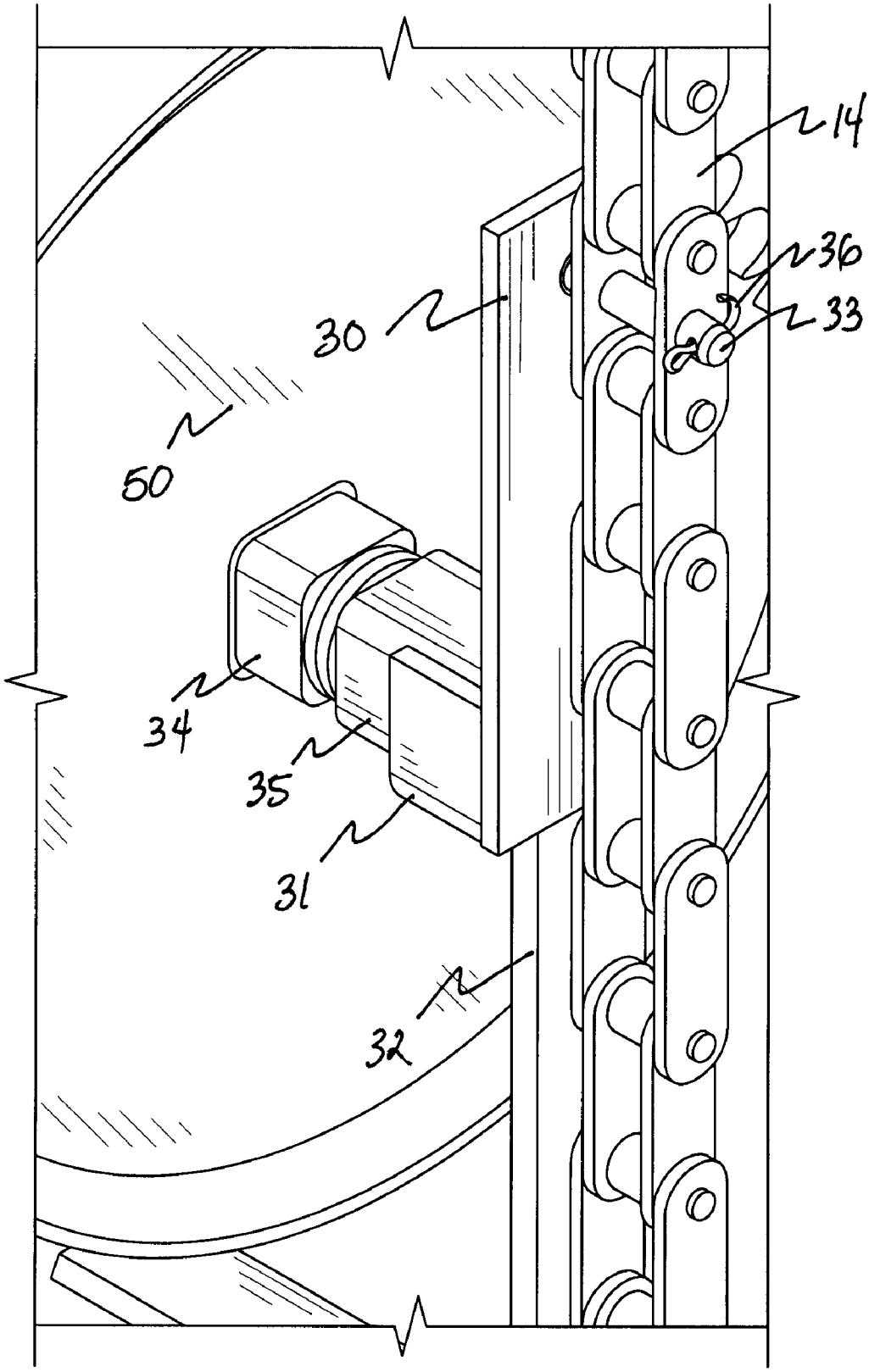
FIG. 7 is a close up perspective view of the rotating ends of a spool as placed within a pivot as shown in FIG. 1.
Figure 8:
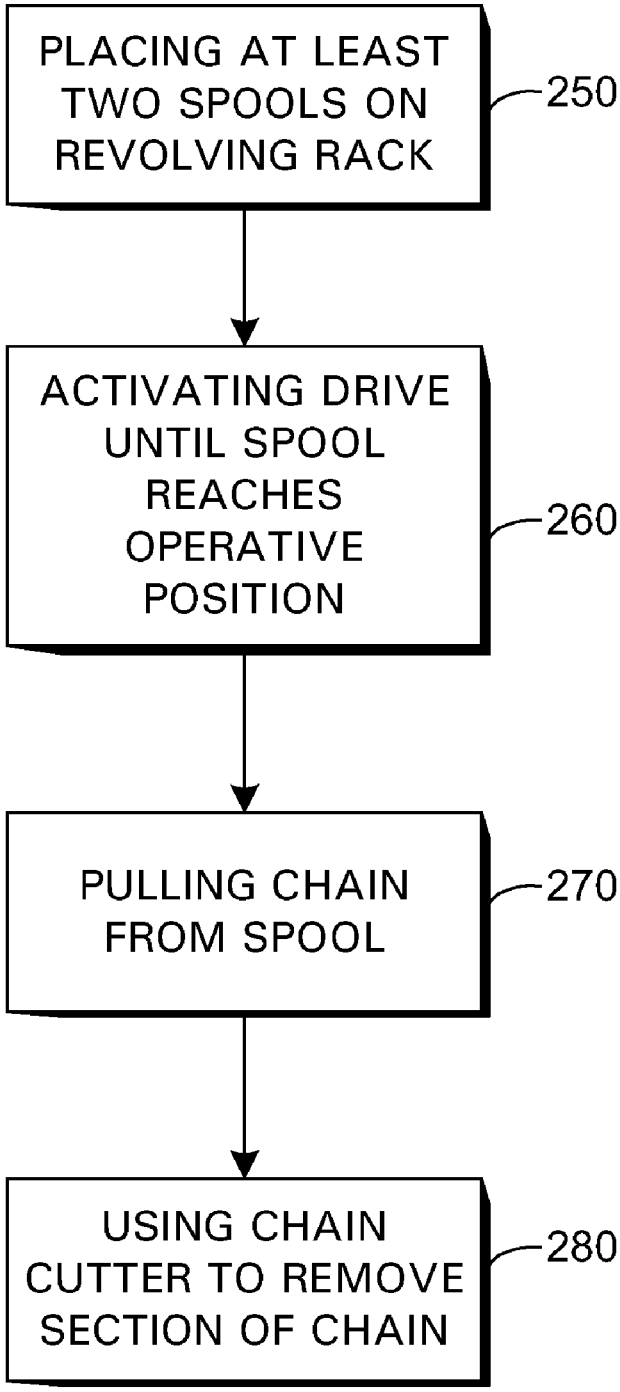
FIG. 8 is a block diagram of a method for selecting chain from different spools according to a possible embodiment.

FIG. 7 shows how the spool holder 30 can be attached in one possible configuration by a fixation pin 33 and a lock 36. If the spool holder 30 is attached in a freewheeling mode to the rotating mechanism 10, the cradle holder 32 serves as balance weight and prevents rotation of the spool 50 during movement of the rotating mechanism 10.

What is contemplated and shown in FIG. 6 is an inoperative position where the position of a spool 50 is not located judiciously around the rotating mechanism 10 to allow an operator the most comfortable use. What is contemplated in the operative position is a position that is not an inoperative position. One of ordinary skill in the art recognizes that the determination of the operative and inoperative positions is not a precise location and is better qualified in association with usefulness. The operator may be able to pull a part of the chain 60 from a lower or higher position without substantially altering the functionality of the revolving rack 100. In addition, the drive 40 may disallow the stabilization of any spool 50 at a precise position due to the important inertia of the revolving rack 100 or disallow backwards movement once the target destination is reached.

In one embodiment shown in FIG. 1, the frame 20 is made of a fixation section 22 made of steel profiles 23 attached in a rectangular configuration and placed over legs 24 also made in a rectangular configuration. In one embodiment, what is contemplated is the use of a rigid fixation section 22 with legs 24 having sufficient height and separation to allow the forks of a forklift (not shown) to be inserted between the legs for forklift manipulation. In another embodiment, the floor clearance created by the legs 24 is at least two inches to allow for the insertion of the forks of a forklift (not shown). What is also contemplated but not shown is a bolted or welded fixation of the fixation section 22 at a permanent location. What is also contemplated but not shown is the use of plates, sections, or devices to allow for a forklift equipped with any type of lifting equipment to grasp the fixation section 22 for manipulation.

Figure 2:
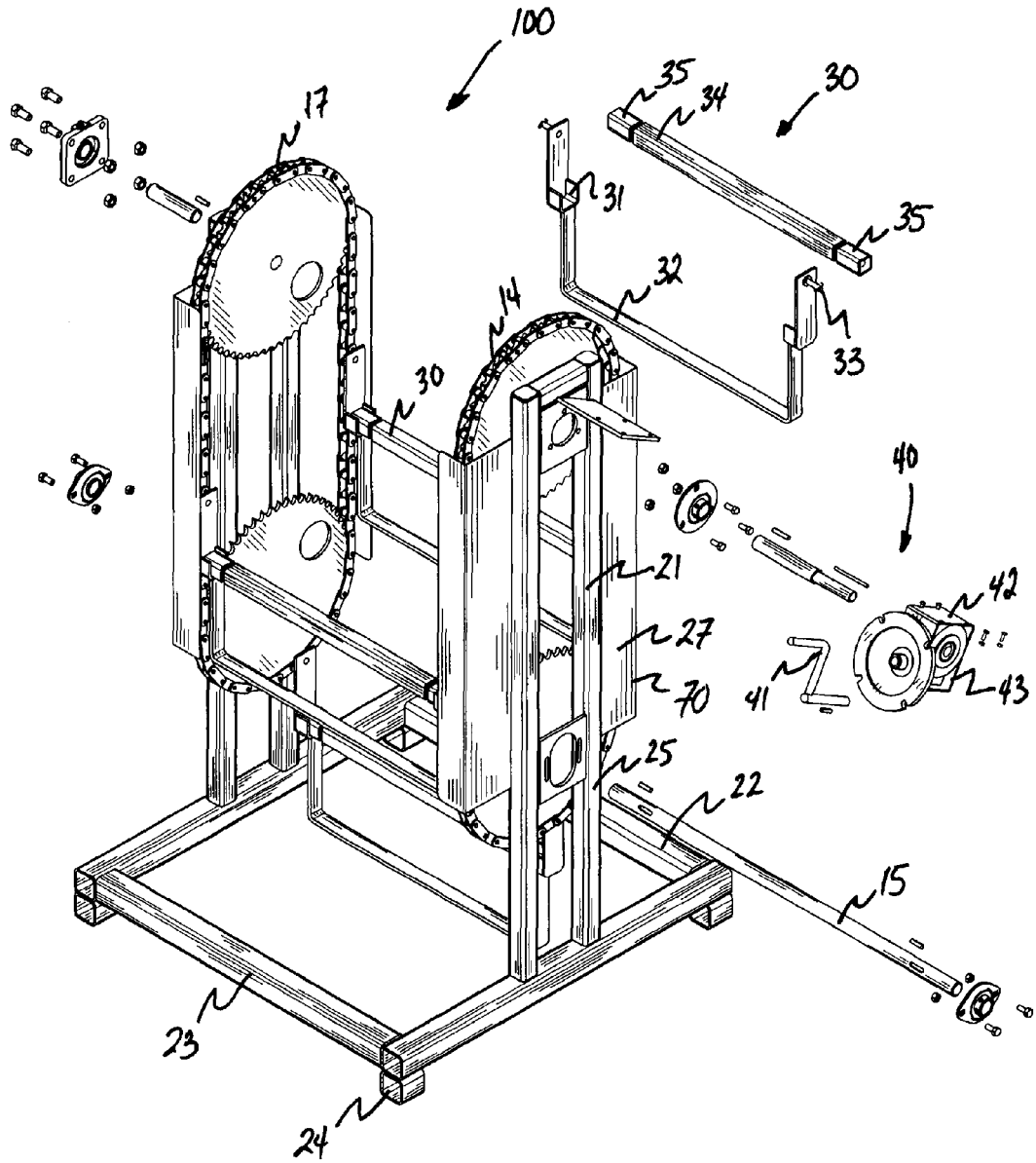
FIG. 2 is an exploded view of the revolving rack for chain spools with guard and spool holders but without spools according to a possible embodiment.
Figure 3:
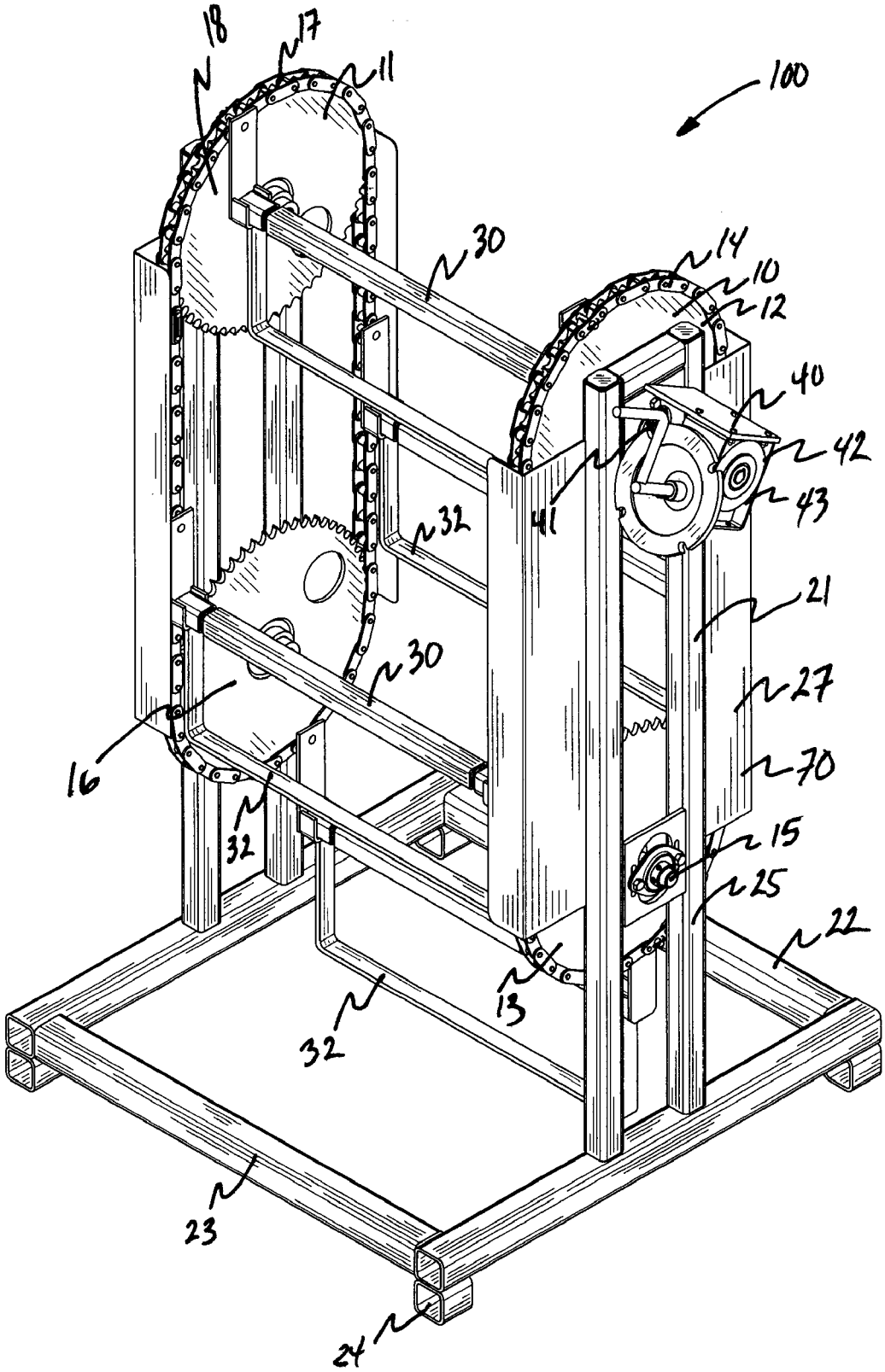
FIG. 3 is a perspective view of the revolving rack for chain spools of FIG. 2 according to a possible embodiment.
Figure 4:
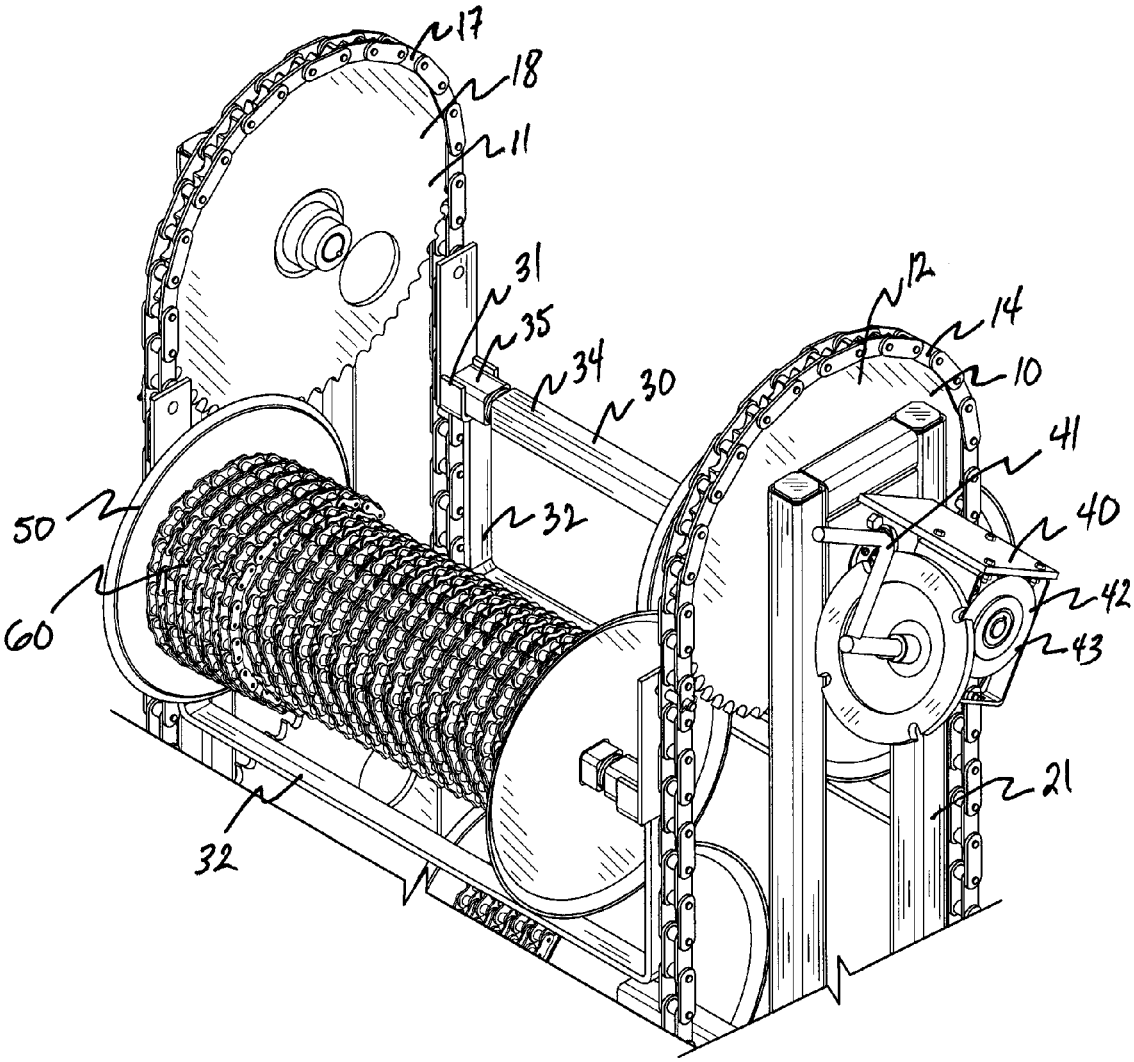
FIG. 4 is a close-up perspective view of the top portion of the revolving rack of FIG. 1 according to a possible embodiment.

The frame 20 also comprises an operative section 21 welded to the fixation section and made of two sets of vertical rectangular steel bars 25 with a top bar 26 to complete the rigid structure. A guard 27 as shown in FIG. 2 can be attached to the operative section 21 for protecting the rotating mechanism 10 from shocks. While one possible type of structure is shown as the operative section 21 of the frame 20, what is contemplated is any type of structural element capable of being used as a support element in the frame 20. The guard 27 as shown is a small, bent piece of metal attached to the operative section 21, but what is contemplated is the use of any type of guard or protective structure designed to offer adequate protection of the rotating rack 100 in environments in which use is contemplated.

One of ordinary skill in the art recognizes that while a series of four spool holders are shown within the rotating mechanism 10, what is contemplated is the use of any quantity or type of spool holders in association with a rotating mechanism and a frame 20 of any scale. By way of nonlimiting example, the revolving rack 100 and the frame may vary in structure or scale greatly if extremely large chains for holding, for example, an aircraft carrier anchor or miniature chain used in the jewelry industry. In one preferred embodiment, the frame 20 is covered with black paint, but any surface finish and color is also contemplated.

FIG. 2 is an exploded view of the revolving rack 100 for chain spools 50 with a guard 27 and spool holders 30 but without spools 50 according to a possible embodiment. Each of the plurality of spool holders 30 includes a pivot 31 for pivotally holding a spool 50, a cradle holder 32 for protecting the spool 50, and a fixation pin 33 for pivotally connecting the spool holder 30 to the rotating mechanism 10. What is contemplated is the use of spools 50 with or without fixation ends (not shown). In one commercial embodiment, the spool 50 is made of a hollow cylinder where a central support 34 can be inserted. The central support 34 may be equipped with either rotating ends 35 or a cylindrical end for pivotal connection with the pivot 31. What is also contemplated is the use of a friction based torque mechanism located within the rotating ends 35 to limit the differential rotation between the central support 34 and the rotating ends 35. FIG. 7 is a close-up perspective view of the rotating ends 35 of a spool 50 placed within a pivot 31.

Figure 5:
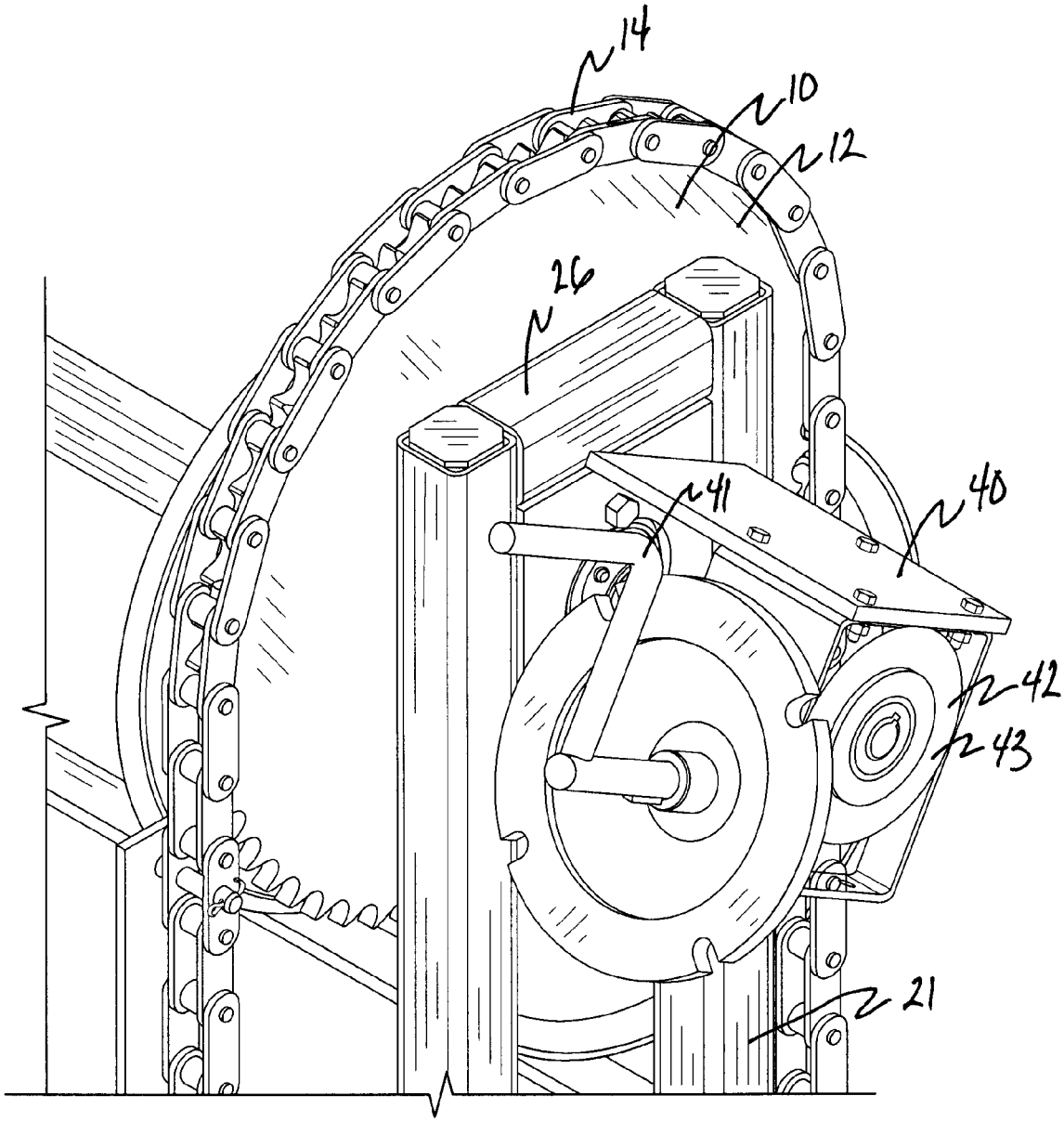
FIG. 5 is a close-up view of the drive mechanism of FIG. 1 according to a possible embodiment.

In one embodiment as shown in FIG. 2, the drive 40 includes a manual lever 41 for manually activating the rotating mechanism 10 and a motor 42 for automatically activating the rotating mechanism 10. The drive 40 can include a clutch 43 operating between the manual lever 41 and the motor 42 for selecting between manual and automatic activation of the rotating mechanism. What is not shown is the use of an electrical plug and cable to connect the electrical motor 42 to a power supply, but the connection of an electrical motor 42 to a power supply is well known in the art. In one embodiment, the drive 40 is fully manual. The drive 40 rotates the top right sprocket 12, but what is contemplated is the use of any type of drive mechanism 10 in conjunction with any type of drive 40 to move the spools 50 from an inoperative position to an operative position. FIG. 5 is a close-up view of the drive 40.

What is also disclosed is a method of selecting chain 60 from different spools 50, the method comprises the step of placing 250 at least two spools 50 with a rolled chain 60 on a revolving rack 100 for chain spools 50 comprising a frame 20 having an operative section 21 and a fixation section 22, a rotating mechanism 10 connected to the operative section 21 for holding a plurality of spool holders 30, and a drive 40 connected to the rotating mechanism 10 for moving the plurality of spool holders 30 from an inoperative position to an operative position. The method also comprises the step of activating 260 the drive 40 until a selected spool 50 reaches the operative position and pulling 270 the chain 60 from spool 50 for distribution of the chain 60. In another embodiment, the method further comprises the step of using 280 a chain cutter 200 to remove the section of chain 61 pulled from the spool 50 for distribution.

Persons of ordinary skill in the art appreciate that although the teachings of the disclosure have been illustrated in connection with certain embodiments and methods, there is no intent to limit the invention to such embodiments and methods. On the contrary, the intention of this disclosure is to cover all modifications and embodiments failing fairly within the scope the teachings of the disclosure.

What is claimed is:

1. A revolving rack for chain spools, comprising: a frame having an operative section and a fixation section; a rotating mechanism connected to the operative section, the rotating mechanism including two pairs of sprockets, each pair of sprockets mechanically connected by a drive chain, and a drive shaft for coupling one sprocket in each of the pair of sprockets; a plurality of spool holders removably and pivotally connected to the rotating mechanism by a fixation pin inserted through an aperture formed in each of a pair of aligned plates that define one link in the drive chain, the aperture disposed between a pair of pins connected to said one link and that connect said one link to adjacent links in the drive chain, each of the plurality of spool holders including a pivot for pivotally holding a spool for relative movement between the pivot and the spool and a cradle holder extending from the pivot to prevent external contact with the spool, wherein the spool includes a wound length of chain and the pivot includes a pair of intersecting planar walls disposed normal to one another; a central support fixed to a central opening in the spool such that the central support and the spool rotate synchronously without relative movement therebetween, the central support including rotating ends that facilitate relative movement between the central support and the rotating ends, the rotating ends including a pair of intersecting planar sides disposed normal to one another and placed within the pivot so that each of the pair of intersecting planar sides engage one of the pair of intersecting planar walls such that the central support rotates relative to the rotating ends and the pivot; and a drive connected to the rotating mechanism for moving the plurality of spool holders from an inoperative position to an operative position.

2. The revolving rack for chain spools of claim 1, wherein the frame further includes a guard for the rotating mechanism.

3. The revolving rack for chain spools of claim 1, wherein the drive includes a manual lever for manually activating the rotating mechanism, a motor for automatically activating the rotating mechanism, and a clutch operating between the manual lever and the motor for selecting between the manual activation and the automatic activation of the rotating mechanism.

4. The revolving rack for chain spools of claim 1, wherein the rotating mechanism holds four spool holders for holding four different spools.

5. The revolving rack as recited in claim 1, wherein one of the central support and the rotating ends include a tension mechanism disposed therein to limit differential rotation between the central support and the rotating ends.

6. The revolving rack as recited in claim 5, wherein the tension mechanism is selectively adjustable with respect to a rate of unwinding of the chain.

7. The revolving rack as recited in claim 5, wherein the tension mechanism is friction-based torque mechanism.

8. The revolving rack as recited in claim 5, wherein the tension mechanism operates automatically.

* * * * *